United States Patent [19]

Prats et al.

[11] Patent Number: 4,601,338

[45] Date of Patent: Jul. 22, 1986

[54] FOAM AND IMPEDANCE-GUIDED STEAM INJECTION

[75] Inventors: Michael Prats, Houston, Tex.; Paul B. Ritter, Jr., Bakersfield, Calif.

[73] Assignee: Shell Oil Company, Houston, Tex.

[21] Appl. No.: 698,198

[22] Filed: Feb. 4, 1985

[51] Int. Cl.[4] ..... E21B 43/04; E21B 43/24

[52] U.S. Cl. ..... 166/278; 166/303; 166/309

[58] Field of Search ..... 166/278, 303, 305.1, 166/272, 309

[56] References Cited

U.S. PATENT DOCUMENTS 3,587,741 6/1971 Casey ..... 166/278
3,994,345 11/1976 Needham ..... 166/303
4,445,573 5/1984 McCaleb ..... 166/303
4,532,993 8/1985 Dilgren et al. ..... 166/303

*Primary Examiner*—Stephen J. Novosad
*Assistant Examiner*—William P. Neuder

[57] ABSTRACT

A selective injection of gaseous fluid into a portion of a subterranean reservoir is improved by positioning an impedance to fluid flow in the annulus between a pipe string and a surrounding permeable-walled conduit, ensuring the presence of granular solids between the permeable-walled conduit and the reservoir, injecting the gaseous fluid through the pipe string to a point below the impedance and injecting fluid which is more viscous than the gaseous fluid down the annulus to restrict bypassing of the impedance.

10 Claims, 1 Drawing Figure

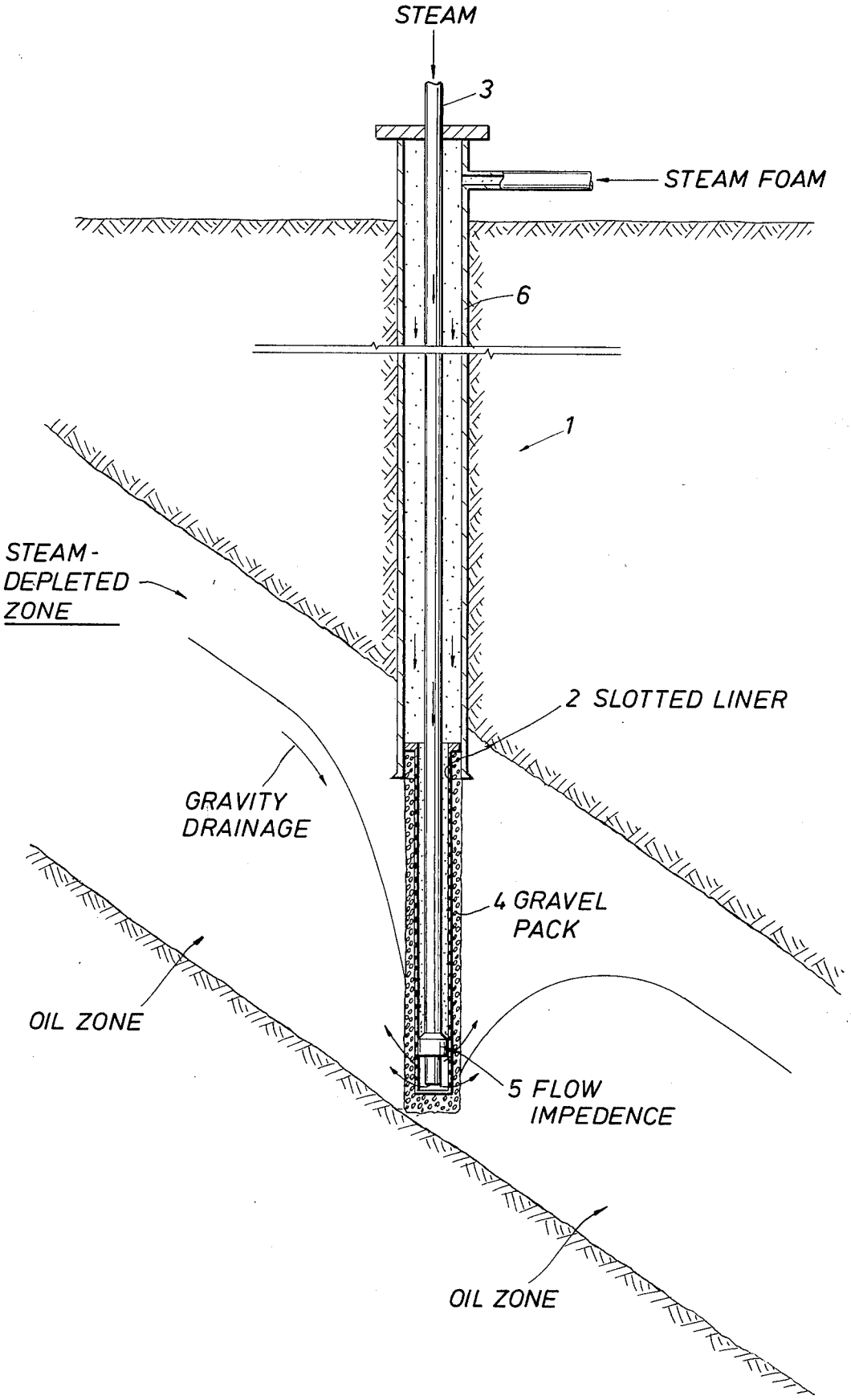
STEAM
3
STEAM FOAM
6
1
STEAM-
DEPLETED
ZONE
2 SLOTTED LINER
GRAVITY
DRAINAGE
4 GRAVEL
PACK
OIL ZONE
5 FLOW
IMPEDENCE
OIL ZONE

FOAM AND IMPEDANCE-GUIDED STEAM INJECTION

BACKGROUND OF THE INVENTION

This invention relates to a steam injection process for oil recovery. More particularly, it relates to an improved method of injecting a gas or vapor into a subterranean reservoir formation in which it is desirable to inject such a gaseous fluid, preferentially into a selected portion of the reservoir.

Numerous procedures have been proposed for steam soaking reservoirs. The prior proposals include patents such as the following: U.S. Pat. No. 3,354,958 describes a steam soak process using a packer to seal the annulus between concentric tubing and casing strings above perforations in the casing string. Such a preferential injection of steam into the lower portion of the reservoir depends on good seals between the packer, casing and reservoir. U.S. Pat. No. 3,410,344 describes a steam soak process conducted without a packer by pressurizing a column of foam within the annulus between the tubing and a perforated casing so that the location of the steam injection is determined by the depth of the column of foam. This tends to be difficult and expensive since the location of the bottom of that column is difficult to detect and is susceptible to wide variations in response to small variations in the pressures of the steam or foam. U.S. Pat. No. 4,445,573 describes a steam soak process which is conducted without a packer by effecting a prior or concurrent injection of a noncondensible gas foam to preferentially plug the most permeable zones in the reservoir before they are entered by significant proportions of steam.

SUMMARY OF THE INVENTION

The present invention relates to a gaseous fluid injection process in which it is desirable to inject that fluid through a tubing string which is surrounded by a permeable-walled conduit in a manner causing a preferential injection of the gaseous fluid into a selected portion of the reservoir. In a location at least near but above that at which the preferential injection is to be effected, solid granules are introduced into the space between the permeable-walled conduit and the reservoir formation to an extent sufficient to ensure that the vertical permeability within that space is not significantly more than the permeability provided by the interstices between a mass of gravel-sized particles. A mechanical impedance to fluid flow is positioned between the tubing string and the surrounding permeable-walled conduit at a location just above that at which the gaseous fluid is to be preferentially injected into the reservoir. The impedance is arranged to provide a significantly increased resistance to vertical flow through the impeded zone. A fluid which is significantly more viscous than the gaseous fluid is injected into the annulus between the tubing and the surrounding permeable-walled conduit at a rate and pressure such that at least near the mechanical impedance, the pressure on the viscous fluid exceeds the pressure at which the gaseous fluid is to be injected into the reservoir. The gaseous fluid is injected through the tubing string and into the reservoir below the mechanical impedance.

BRIEF DESCRIPTION OF THE DRAWING

The drawing is a schematic illustration of a well in which the process of the present invention is being employed.

DESCRIPTION OF THE INVENTION

The present invention is, at least in part, premised on the following discoveries. A fortuitous combination exists between flow properties of (a) substantially single component gaseous fluids useful for displacing oils within subterranean reservoirs (b) fluids which are significantly more viscous than such gaseous fluids with respect to flowing through openings at least about as small as the interstices between the granules of a substantially homogeneous gravel pack at the temperature at which the gaseous fluid is to be injected into a subterranean reservoir formation and (c) the interstices in and around a mechanical flow impedance which is capable of being installed between a tubing string and surrounded permeable-walled conduit within the borehole of a well. When a generally homogeneous mass of granules at least as small as those of gravel packing particles exists or is installed within the space between such a tubing and conduit, at least near and above such an impedance, such a viscous fluid can be pressurized against that mass at a pressure exceeding that at which the gaseous fluid is to be injected and can cause substantially all of the gaseous fluid to enter the reservoir below the impedance.

In contrast to the problems of prior processes for effecting a preferential injection of a gaseous fluid, little or no problems are created by variations no larger than those which are readily avoidable in the pressures of the gaseous and relatively viscous fluids. Similarly, the flow impedance provided by the sealing in and around the impedance and the well casing need not be much more than those provided by a sand or gravel pack.

For example, where the gaseous fluid is steam and the relatively viscous fluid is a steam foam, the pressure on the column of steam foam can be maintained at a moderate excess above the steam injection pressure. Such a pressure may cause only a small amount of the foam to flow below the mechanical impedance or into the reservoir formation while keeping steam from flowing through the mechanical impedance or upward within the space between the permeable-walled conduit and the reservoir formation. The upflowing of the steam is prevented by the presence of foam in at least the uppermost or innermost portions of the interstices between the granular solids and solid elements of the mechanical impedance. In addition, to the extent to which the foam does flow into the reservoir, it will heat any oil-containing portion of the reservoir that it enters and, being a steam foam, will become more mobile as a result of the cooling of the portion of the reservoir in which it is located. In some situations it may be desirable to use a steam foam which contains relatively little steam-foam-forming surfactant and tends to flow into the reservoir to provide a radially expanding impediment to the upward migration of the steam being injected below the mechanical impedance.

The drawing shows well 1 completed into an interval within an oil containing reservoir having a greater permeability in its upper portion due to a surrounding "steam depleted zone" which has become relatively free of oil. The well contains a permeable-walled conduit, such as a slotted liner 2 surrounding a tubing string 3 into which steam is being injected. The liner 2 is surrounded by a gravel pack 4 within which substantially all of the permeability is limited to the interstices between the gravel pack particles. In the lower portion of the reservoir interval, a flow impedance 5, such as a packer or one or more elastomeric cups, is positioned in the annulus between the tubing string and the liner.

In the situation shown, preformed steam foam is being injected into the annulus between the tubing 3 and casing 6 and flowed between tubing 3 and liner 2 at a rate and pressure such that the pressure on the foam in the vicinity of the flow impedance 5 exceeds the pressure at which the steam is being injected into the reservoir. The resistance of the foam to flowing through the interstices between the solid materials in the gravel pack 4 and in and around flow impedance 5 are such that the foam mobility can be adjusted to keep most of the foam within or adjacent to the borehole of the well at a depth above that at which the flow impedance is positioned.

Where desired, some steam foam can be caused to enter the reservoir formation above the location of the impedance. It is not detrimental if some foam leaks through the gravel pack, as long as it does not affect the steam placement. What is important is that little of the steam leaks through the gravel pack and around the impedance and into the portion of the reservoir above the impedance.

The process of the present invention is generally applicable to substantially any subterranean reservoir formation. It is particularly suitable for use in a heavy oil reservoir in which the effective permeability to steam is significantly greater within the upper portion of the reservoir to an extent causing an injected steam to override the oil.

Granular solid material suitable for being deposited, when needed, in spaces between a permeable-walled conduit, such as a liner, screen or perforated casing, need only be used where substantially solids-free and vertically extensive spaces exist to an extent sufficient to cause the bottom of a steam foam column to rise or fall in response to relatively minor variations between the pressure on the steam foam or the steam being injected into the reservoir. Such granular materials can comprise substantially any relatively inert solid granules, such as those used for the sand or gravel packing of wells, etc. Pre-existing sand or gravel packs can be utilized as long as they are relatively homogeneous to an extent such that they are free of significant proportions of vertically extensive solids-free channels or cavities.

A flow impedance suitable for placement between the tubing string and surrounding perforated conduit in accordance with the present invention can comprise substantially any type of mechanical device which is suitable for being run into the well to the desired location and is capable of providing a significant impedance to the vertical flow of fluid. Elastomeric washer type cups, steam-stable packing devices or retainers, etc. can be used. Steam stable elastomeric washer type cups are particularly suitable.

The impedance and surrounding mass of solid granules can be located near the top, bottom or middle of a reservoir formation encountered by a well.

The relatively viscous fluid which is pressurized against the mass of granules surrounding the impedance can be substantially any which is (a) significantly more viscous than the gaseous fluid to be injected with respect to flowing through openings at least about as small as the interstices between the granules of a substantially homogeneous gravel pack at the temperature at which the gaseous fluid is to be injected and (b) compatible with the fluids and solids to be encountered in and around the well. Foams and/or emulsions of relatively inert gases such as steam, nitrogen, $CO_2$, flue gas, etc. with liquids such as relatively inert aqueous liquids or vapors, hydrocarbon liquids or vapor, etc. Particularly preferred fluids comprise steam or hot water foams of the types described in U.S. Pat. No. 4,086,964 by R. E. Dilgren, G. J. Hiraski, D. G. Whitten and H. J. Hill; 4,161,217 by R. E. Dilgren and K. B. Owens and 4,393,937 by R. E. Dilgren and K. B. Owens.

In general, the gaseous fluid to be injected in accordance with the present process can comprise any which is relatively non-viscous. It is preferably a substantially single component fluid, such as a wet, dry or superheated steam, vapors of one or more hydrocarbons, vaporized $CO_2$, etc.

What is claimed is:

1. In a well treating process within a reservoir in which a gaseous fluid is injected through tubing surrounded by a permeable-walled conduit in a manner tending to provide a preferential inflow into a selected portion of the reservoir, an improvement comprising:

in a location near but above that at which the gaseous fluid is to be injected into the reservoir, introducing solid granules into the space between the permeable-walled conduit and the reservoir to an extent sufficient to ensure that the vertical permeability in that space is not significantly more than the permeability provided by the interstices between a mass of gravel-sized solid particles;

positioning a mechanical fluid-flow-impeding means within the annulus between the tubing string and the permeable-walled conduit at a depth which is below the top of said mass of gravel-sized particles and is just above the depth at which the gaseous fluid is to be injected into the reservoir;

injecting fluid which is significantly more viscous than the gaseous fluid through the annulus and into said mass of particles above the mechanical flow impeding means at a rate and pressure such that the fluid pressure near the impedance exceeds the pressure at which the gaseous fluid is to be injected into the reservoir; and injecting the gaseous fluid through the tubing string and into the reservoir below the mechanical flow impeding means.

2. The process of claim 1 in which the permeable-walled conduit comprises a perforated liner or screen at the depth of the reservoir interval.

3. The process of claim 2 in which the granular solids filling the annulus between the permeable-walled conduit and the reservoir are those of a previously installed gravel pack.

4. The process of claim 1 in which said flow impeding means is a pair of elastomeric cups.

5. The process of claim 1 in which the permeable-walled conduit is a perforated or slotted liner or screen surrounded by a perforated casing.

6. The process of claim 1 in which the flow impedance is a packer or retainer.

7. The process of claim 1 in which the fluid which is significantly more viscous than the gaseous fluid is a steam foam.

8. The process of claim 7 in which the steam foam is formed by a mixture of steam, water, surfactant, electrolyte and noncondensible gas.

9. The process of claim 8 in which the viscosity of the steam foam is arranged to allow a significant flow of steam foam into the reservoir formation.

10. The process of claim 9 in which the well treating process is a steam soak process for recovering oil.

* * * * *